US005517926A

United States Patent [19]

Young, Jr.

[11] Patent Number: 5,517,926

[45] Date of Patent: May 21, 1996

[54] COLLAPSIBLE PALLET

[75] Inventor: Robson T. Young, Jr., Kirkland, Ill.

[73] Assignee: National Pallet L.L.C.

[21] Appl. No.: 307,313

[22] Filed: Sep. 16, 1994

[51] Int. Cl.[6] ..... B65D 19/00

[52] U.S. Cl. ..... 108/51.3; 108/56.1

[58] Field of Search ..... 108/51.3, 51.1, 108/56.1

[56] References Cited

U.S. PATENT DOCUMENTS

| | | | |
|---|---|---|---|
| 2,446,914 | 8/1948 | Fallert et al. | 108/51.3 |
| 2,665,095 | 1/1954 | Vogel | 108/56.1 |
| 3,434,435 | 3/1969 | Achermann et al. | 108/51.3 |
| 3,628,469 | 12/1971 | Neitzke | 108/51.3 |
| 3,911,834 | 10/1975 | Quaintance | 108/51.3 |
| 4,378,743 | 4/1983 | McFarland | 108/51.3 |
| 4,714,026 | 12/1987 | Yamaguchi et al. | 108/51.3 X |
| 4,863,024 | 9/1989 | Booth . | |
| 4,927,026 | 5/1990 | Gossler et al. . | |
| 4,949,898 | 8/1990 | Nederveld . | |
| 5,176,090 | 1/1993 | Roberts et al. | 108/51.3 |
| 5,222,444 | 6/1993 | Youell, Jr. et al. | 108/51.3 |
| 5,230,291 | 7/1993 | Juvik-Woods . | |
| 5,269,219 | 12/1993 | Juvik-Woods . | |
| 5,285,731 | 2/1994 | McIntyre | 108/51.3 |
| 5,327,839 | 7/1994 | Herring et al. . | |
| 5,329,861 | 7/1994 | McCarthy . | |

FOREIGN PATENT DOCUMENTS

| | | | |
|---|---|---|---|
| 2260503 | 9/1975 | France | 108/51.3 |
| 779020 | 7/1957 | United Kingdom | 108/51.3 |

*Primary Examiner*—Peter M. Cuomo
*Assistant Examiner*—Janet M. Wilkens
*Attorney, Agent, or Firm*—DeWitt Ross & Stevens

[57] ABSTRACT

A collapsible pallet 10 is provided which includes a pallet base 12 and a plurality of longitudinally extending collapsible or foldable support members 30 connected to the pallet base 12. Each of the support members 30 are foldably connected to the lower surface 16 of the pallet base 12. The collapsible pallet 10 also includes support structures for maintaining the support members 30 in upright position. When the pallet 10 is in full upright position, it is suitable for use by any standard forklift. The pallet 10 may be stored and/or transported in folded configuration.

32 Claims, 8 Drawing Sheets

COLLAPSIBLE PALLET

FIELD OF THE INVENTION

The present invention generally relates to pallets and more specifically to a collapsible or foldable pallet.

DESCRIPTION OF THE PRIOR ART

Pallets have been used for many years for supporting, storing and transporting boxes, crates, barrels, machinery and other items for storage and transportation. Pallets are typically constructed by mounting wooden boards horizontally and parallel to each other on vertical wooden support slats. While functional in design and use, the weight, bulk and expense of wood have led to the desire to use a variety of alternative construction materials and to the development of new pallet designs.

Prior art references which disclose a variety of designs and construction materials for pallets include U.S. Pat. No. 5,329,861 to McCarthy, which discloses a pallet comprising a platform and support channels. The support channels are generally U-shaped, contain cut-outs for fourway accessibility, and are made rigid by support blocks proportionally spaced along the length of the channels. Rigidity is further provided by rigid end caps positioned at the ends of the channel.

U.S. Pat. No. 5,230,219 to Juvik-Woods discloses a pallet comprising a platform and support channels which comprise a full-length U-shaped channel containing a paper honeycomb core for support. U.S. Pat. No. 5,230,291 also to Juvik-Woods discloses a similar design in which the underside of the honeycomb cores of the platform and support channels are enclosed within a single appropriately folded corrugated cardboard sheet.

U.S. Pat. No. 5,327,839 to Herring et al., discloses a pallet comprising a platform, support runners, pedestal-type support blocks, and cross-rails each made of multiple ply corrugated cardboard.

Although these prior art pallets obviate some of the problems related to the expense and weight of wood pallets, they do little to relieve the problem of the bulk associated with pallets. Such bulk is particularly problematic with respect to the transportation and storage of empty pallets.

One attempt to solve the bulk problem associated with the prior art problems is disclosed in U.S. Pat. No. 4,863,024 to Booth, which is directed to a collapsible pallet design constructed mostly from corrugated cardboard. Booth discloses a platform and two or more channels all formed out of a single piece of appropriately folded corrugated cardboard. In operation, the channels' shape is achieved and maintained by inserting removable support cores into the entire length of the channel, and then inserting removable cross-beams at right angles to the channels through appropriately positioned cutouts in the channels and support blocks. To collapse the Booth pallet, both the cross-beams and the support cores are removed from the channel, and the channel is then folded up in an accordion-like manner.

While providing some advantages over the existing prior art designs, the collapsible pallet disclosed in Booth has some disadvantages with respect to its efficiency in use and cost of manufacture. Specifically the Booth pallet requires assembly and disassembly of multiple parts, making handling and storage inefficient. Further, Booth requires particularly aligned cross-beam cutouts in both the channel and in the support core, and such precision cutouts add to manufacturing costs.

The present invention sets forth a design for a collapsible pallet which is advantageous over the designs of the prior art and which has not heretofore been known or taught in the art.

SUMMARY OF THE INVENTION

It is hence an object of the present invention to provide a pallet which is strong in operation and is completely collapsible without requiring significant disassembly.

It is an additional object to provide a pallet which is economical to manufacture.

It is a further object of the present invention to provide a pallet which is lightweight and is easily and compactly storable.

A still further object is to provide such a pallet that is suitable for repeated uses, but which is also completely recyclable.

To achieve these ends, the present invention is directed to a collapsible pallet comprising a planar pallet base having a first upper surface, a second lower surface, a first front end, a second rear end, and first and second opposing sides. The pallet also includes a plurality of longitudinally extending collapsible support members connected to the pallet base. Each support member includes a first attachment wall, a second lower wall, and first and second opposing side walls. The first attachment wall and the second lower wall are foldably connected to the first and second opposing side walls to form an internal channel. Each support member further includes at least one folding support flap.

The present invention is also directed to a collapsible pallet comprising a planar pallet base having a first upper surface, a second lower surface, a first front end, a second rear end, and first and second opposing sides. The pallet also includes at least three spaced apart longitudinally extending support members in parallel position to define first and second fork channels therebetween. The support members are connected to the the pallet base, and each support member includes a first attachment wall, a second lower wall, and first and second opposing side walls. The first attachment wall and the second lower wall are foldably connected to the first and second opposing side walls to form an internal channel. Each support member further has a plurality of folding support flaps integrally connected to the support member to support the support members in an upright position. Each support member also includes at least one support compartment adapted to receive a support block therein, wherein the height of the support block is substantially equal to the height of the opposing side walls of the support member, the width of the support block is substantially equal to the width of the first attachment wall and the second lower wall of the support member, and the length of the support block is substantially equal to the length of the support compartment. The pallet also includes at least one locking tab in each support compartment for releasibly securing the support block to the support compartment. The pallet further includes at least one longitudinally extending cross support integrally connected to the support members.

As such, the present invention will be inexpensive to manufacture, lightweight, easily collapsible and compactly storable. In its simplest embodiment the pallet of the present invention is collapsible without having to be disassembled into separate pieces. In alternative embodiments, support members make the present invention suitable for larger load capacities. Because these support members are of standard size and are, in one embodiment, themselves collapsible, none of the advantages of the simplest embodiment are sacrificed to gain the additional capacity. The present invention, in its various embodiments is suitable for carrying loads ranging from approximately 500 pounds up to approximately 4000 pounds.

Further objects, features, advantages and uses of the present invention will be apparent from the following detailed description when considered in conjunction with the accompanying drawings.

DETAILED DESCRIPTION OF THE INVENTION

Figure 1:
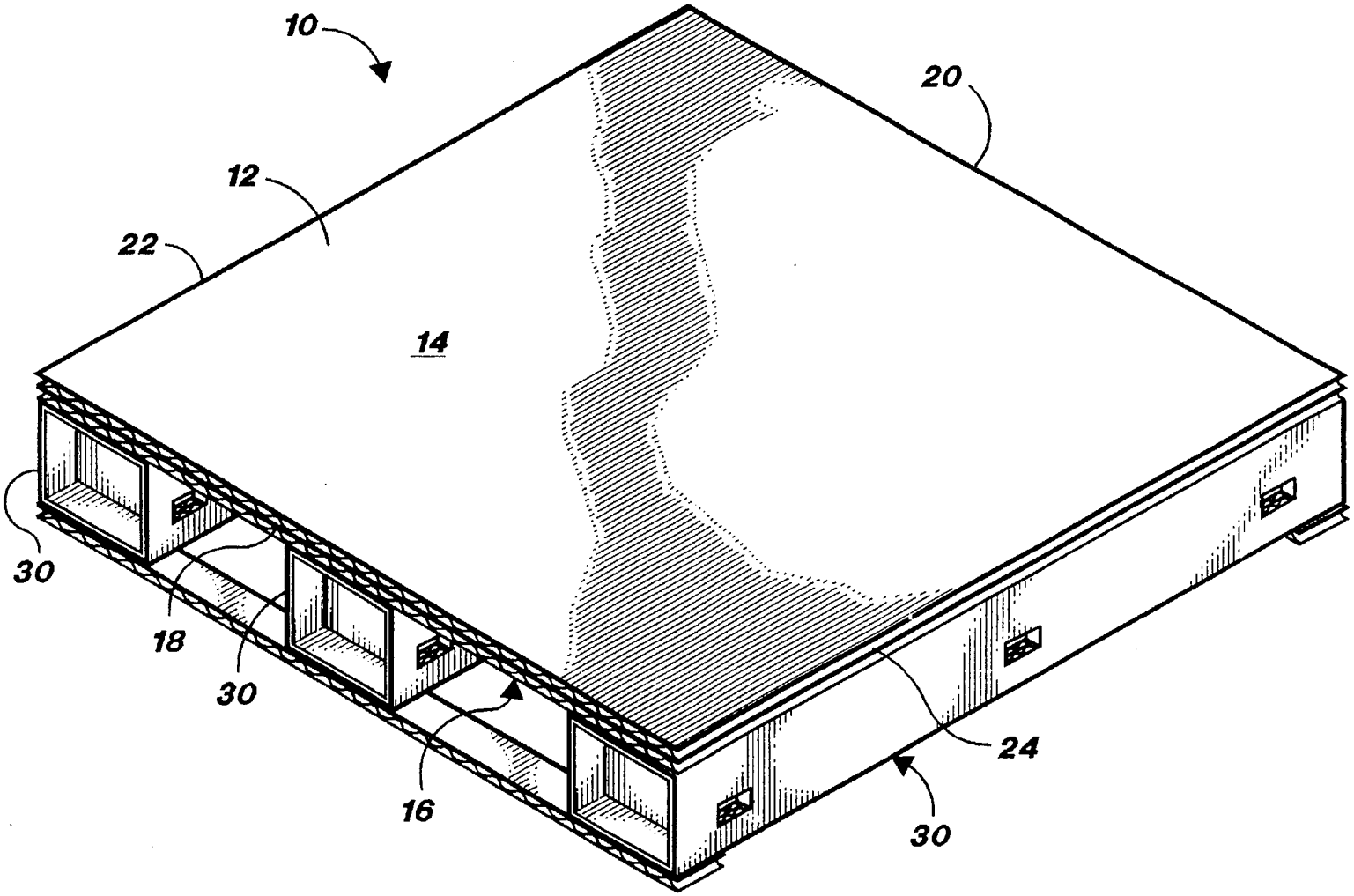
FIG. 1 is a perspective view of the pallet of the present invention.

Referring now to the drawings and particularly FIGS. 1–5, there is illustrated a foldable pallet 10 of the present invention. The pallet 10 may be constructed from a variety of standard materials known to the art, including wood, plastic, fiberglass and conceivably even steel. However, the present invention is preferably constructed from a refoldable material, which for purposes of this invention is considered to include materials which may be alternatingly folded back and forth at a fold line through multiple cycles without degrading the structural integrity of the material at the fold line. Such refoldable materials include fiberboard products such as corrugated cardboard, and a variety of plastic materials known to the art.

The present invention is most preferably constructed of fiberboard materials. As used herein, the term "fiberboard" refers to and includes corrugated fiberboard, corrugated cardboard, chipboard, paper honeycomb, paperboard and similar paper products that are relatively stiff and capable of withstanding substantial loads when manufactured to produce the pallet of the present invention. The fiberboard material may also be derived from recycled materials including cardboard, paper, and the like. Advantageously, the fiberboard materials render the pallet 10 of the present invention readily recyclable and/or biodegradable.

While it is understood that the pallet 10 of the present invention may be made from a variety of materials, the present invention will be described with reference to cardboard or corrugated fiberboard material.

The pallet 10 includes a planar pallet base 12 having a first upper surface 14, a second lower surface 16, a first front end 18, a second rear end 20, and first and second opposing sides 22, 24, respectively. Preferably, the pallet base 12 may be constructed of adhered multi-ply corrugated fiberboard in order to increase the strength of the pallet base 12. As illustrated, particularly in FIG. 1, pallet base 12 comprises a two-ply board material. A typical pallet 10 having a pallet base 12 may be constructed of any size suitable for the intended purpose. Typical sizes include ranges from square or rectangular shapes between 30"×30" to 60"×40". Other sizes are available depending upon the conventions of the industry.

Figure 2:
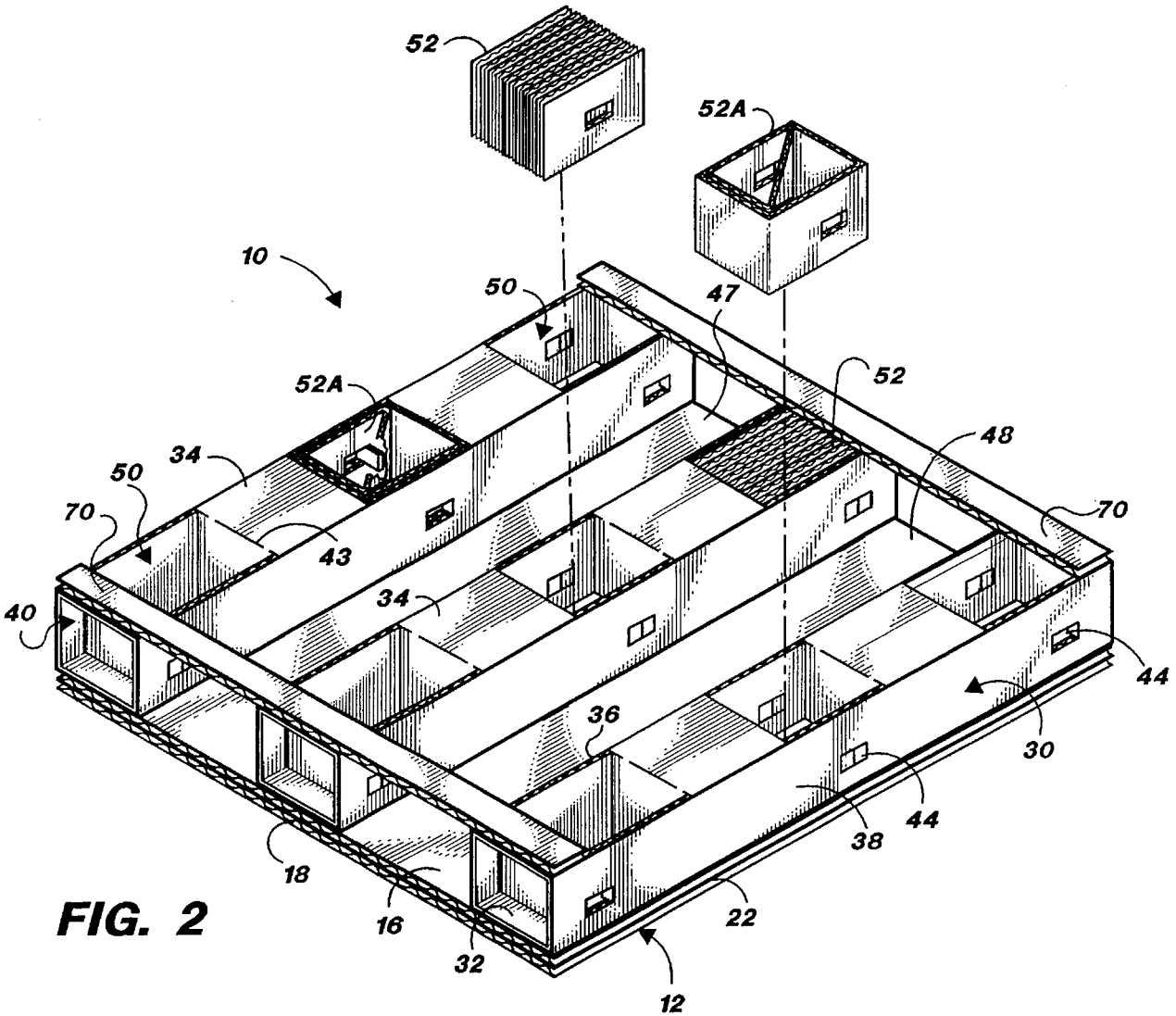
FIG. 2 is a perspective view of the underside of the pallet of FIG. 1.
Figure 3:
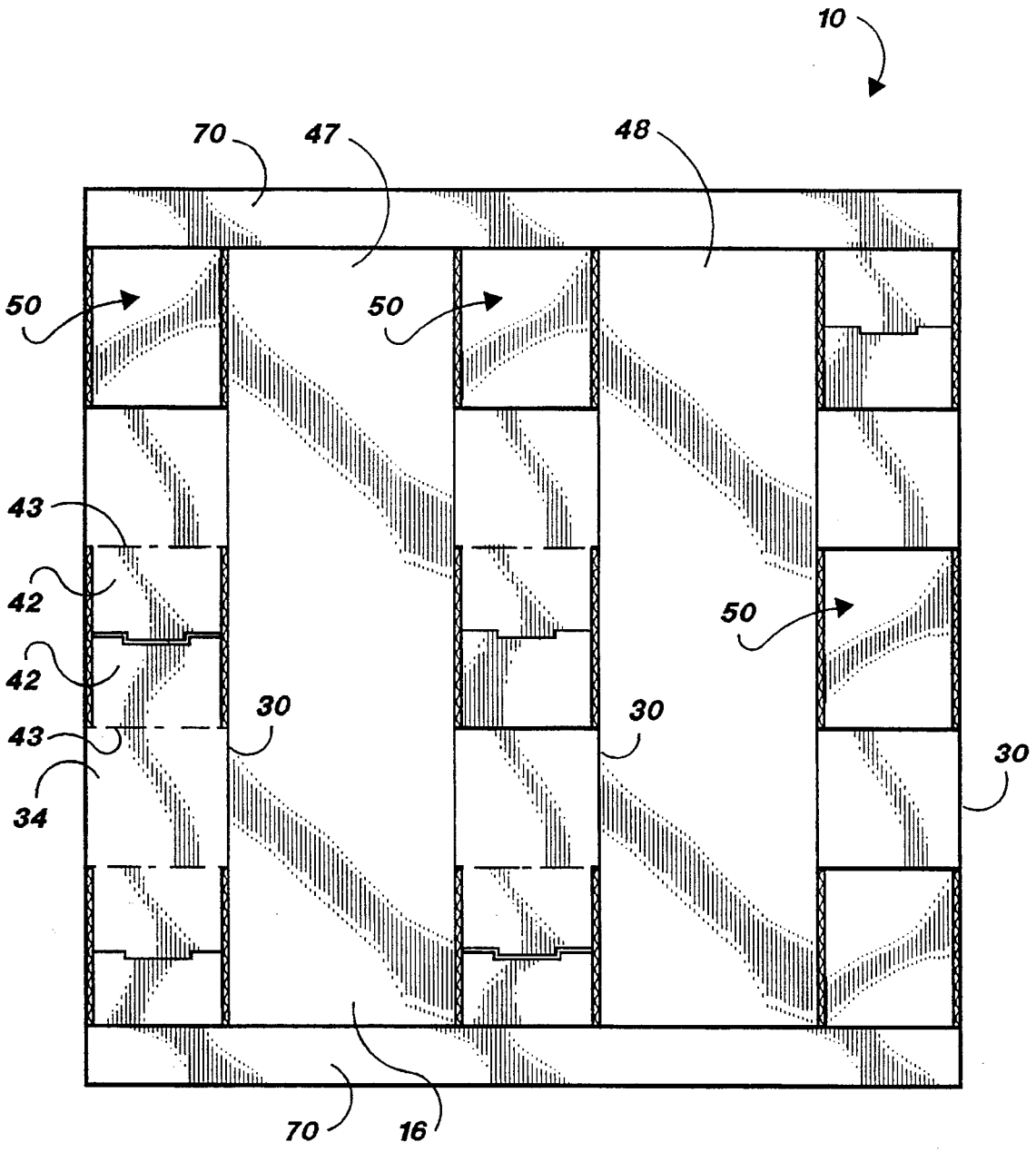
FIG. 3 is a bottom elevated view of the pallet of FIG. 1.
Figure 4:
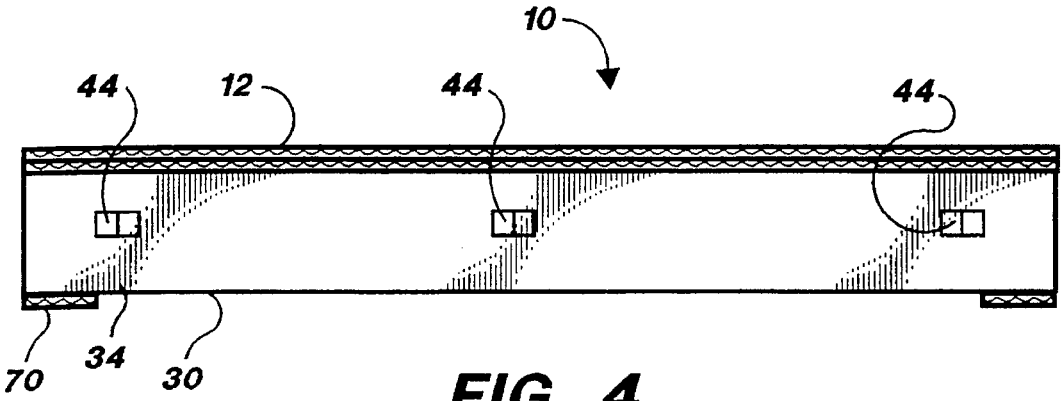
FIG. 4 is a side elevated view of the pallet of FIG. 1.
Figure 5:
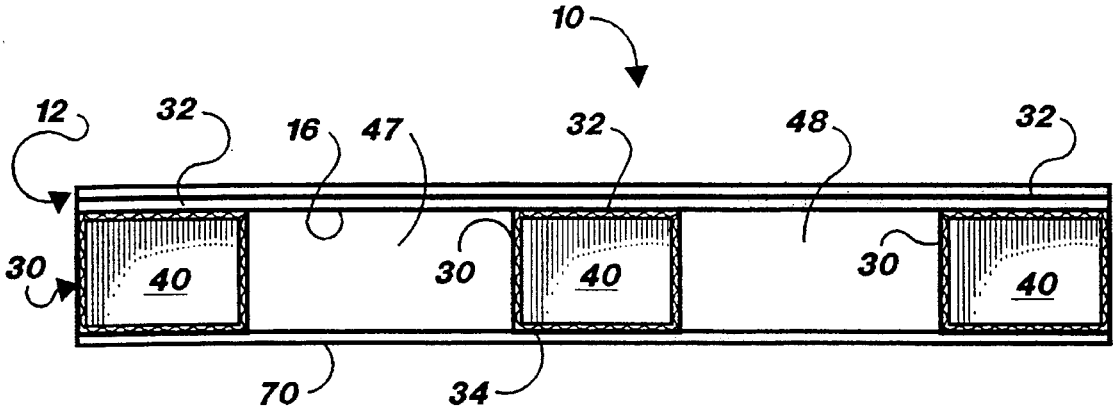
FIG. 5 is an end elevated view of the pallet of FIG. 1.

Attached to the pallet base 12 are a plurality of longitudinally extending collapsible support members 30, which are connected to the second lower surface 16 of the pallet base 12. At least two longitudinal support members are required. Conventionally, three support members 30 are utilized for each pallet 10. The support members 30 are preferably placed in parallel position with the external side walls, 36 or 38, of the external support members 30 being in alignment with the sides 22, 24 of the pallet base. The internal support member 30 is positioned in parallel placement along a median line of the pallet base as illustrated in FIGS. 1 and 2. This positioning of the support members 30 allows for the creation of fork channels 47, 48 which will be described later in the specification.

Figure 7:
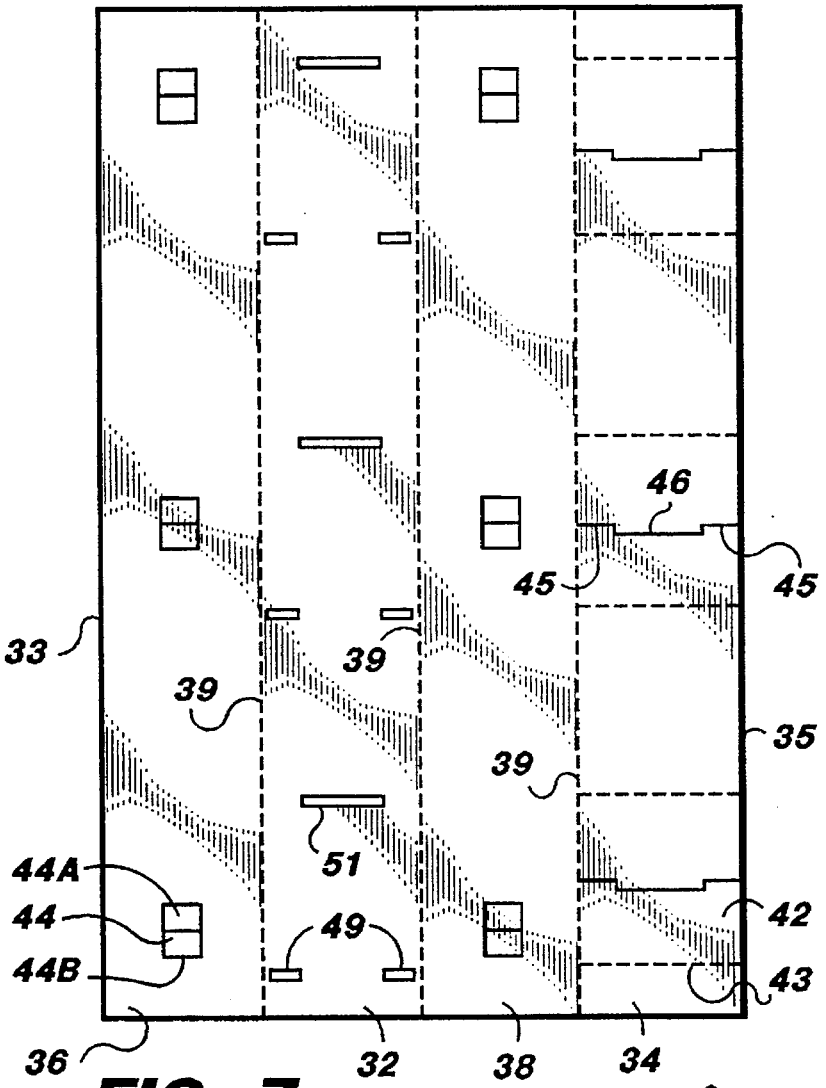
FIG. 7 is a top plan view of the unfolded support member of FIG. 6.
Figure 6:
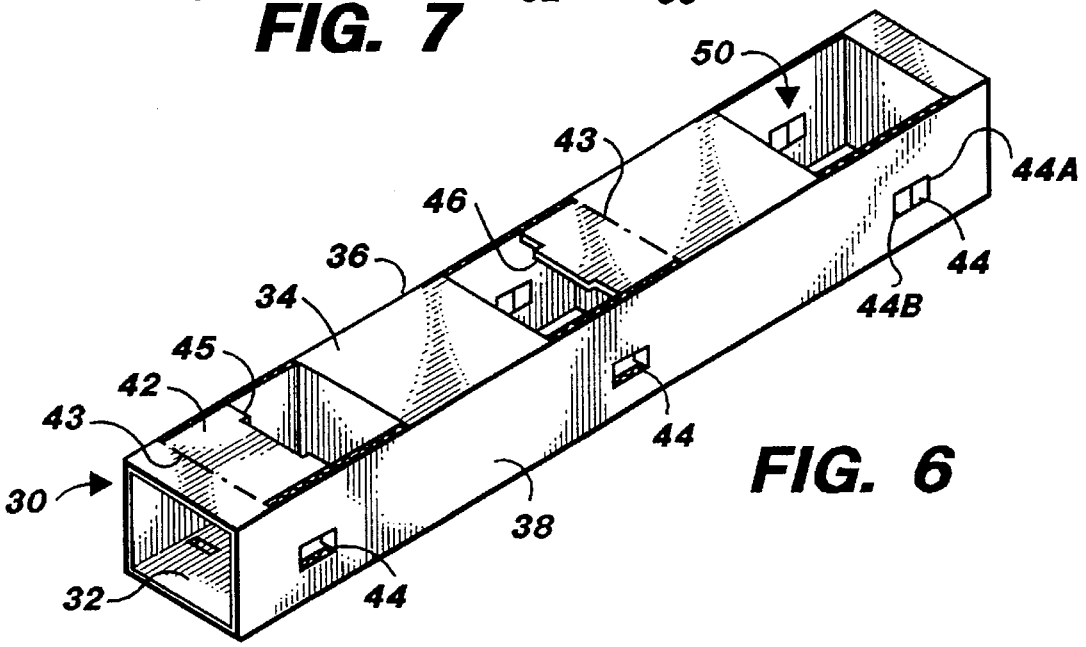
FIG. 6 is a perspective view of the underside of one support member of the pallet of FIG. 1.
Figure 11:
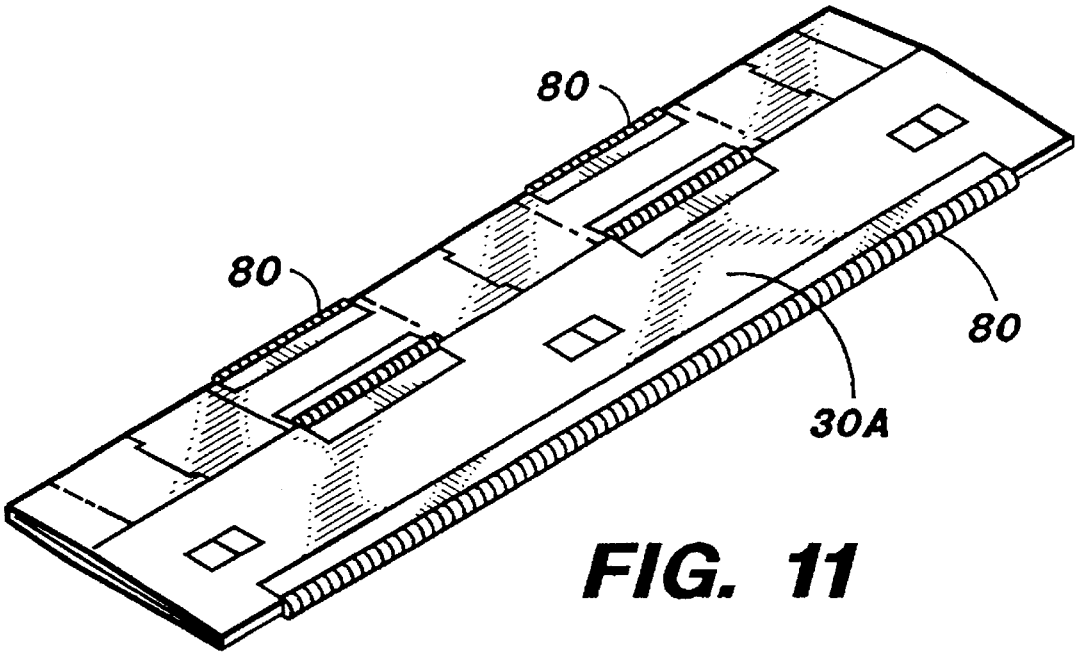
FIG. 11 is a perspective view of an alternative embodiment of a folded support member illustrating a hinged support.
Figure 12:
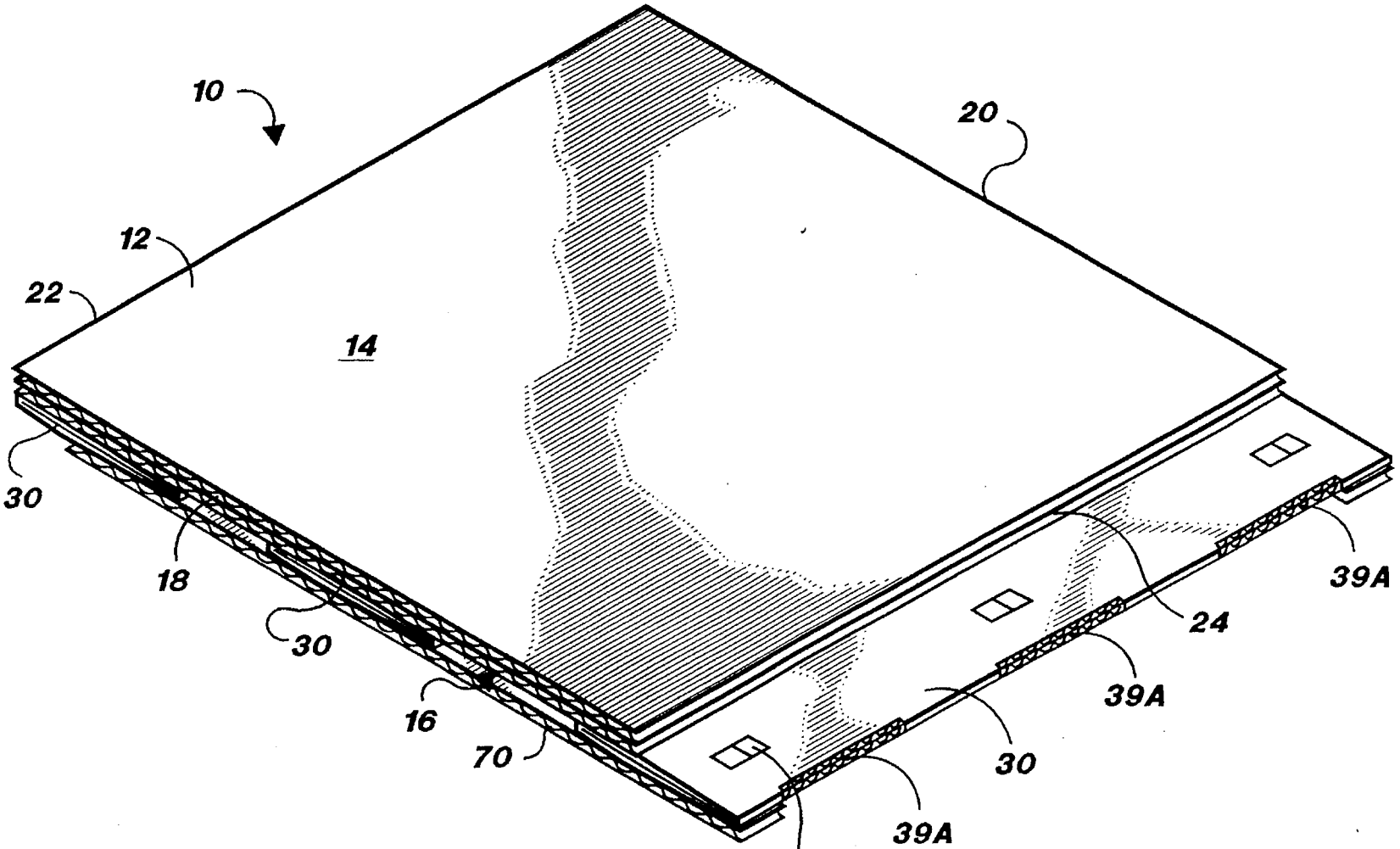
FIG. 12 is a perspective view of the pallet of FIG. 1 in folded condition.

Referring now specifically to FIGS. 2, 6 and 7 there is illustrated a preferred embodiment of the support members 30 of the present invention. The support members 30 include a first attachment wall 32, designed for attachment to the second lower surface 16 of the pallet base 12, a second lower wall or floor surface 34 and opposing first and second side walls 36, 38. In the preferred embodiment, wherein the pallet material is constructed of corrugated fiberboard, the support member 30 is comprised of one sheet of material which may be stamped and cut according to the specifications illustrated in FIG. 7. The support members are provided with fold lines 39, or a combination of foldlines 39 and scorelines 39A as illustrated in FIG. 12, to allow the support member 30 to fold in a substantially planar manner as illustrated in FIGS. 6, 9, 11 and 12.

Referring again to FIG. 7, the support member 30 includes exterior edges 33 and 35. When the support member 30 is folded in the manner illustrated in FIG. 6, edges 33 and 35 are attached by adhesives, glues such as polyvinyl acetate, tape, staples or other means known to the art to form the rectangular or boxed shaped support member 30 as illustrated in FIG. 6. Fold lines 39 allow the support member to be positioned from a flattened position as illustrated in FIG. 11 to an upright position as illustrated in FIG. 6.

The support member 30 is attached to the second lower surface 16 of the pallet base 12 by a variety of means known to the art. Preferred examples include adhesives, tape or other means as described in the previous paragraph. Further, although the support member 30 is shown in the accompanying drawings as comprising a first attachment wall 32 for attaching the support member 30 to the pallet base 12, it is within the scope of the present invention to omit the first attachment wall 32, and to attach the opposing first and second side walls 36, 38 of the support member 30 directly to the pallet base 12. Alternatively, it is within the scope of the present invention to form the collapsible support members 30 from a single continuous sheet of refoldable material appropriately folded to form the first and second opposing side walls 36, 38 with the second lower wall 34 therebetween, in a manner similar to that taught in U.S. Pat. No. 4,863,024 to Booth.

Referring now to FIGS. 2, 3, 5 and 6, the support member 30 in its upright position includes an internal channel 40 and at least one means to support the support member 30 in an upright position. The means to support the support member 30 in upright position includes at least one and preferably a plurality of support flaps 42 integrally connected to the support member. Preferably, the folding support flaps 42 are integrally connected to the second lower wall 34 of the support member 30. However, the folding support flaps 42 may also be integrally connected to either of the opposing side walls 36, 38 of the support member 30. When the collapsible pallet 10 of the present invention is constructed from a refoldable material, such as corrugated fiberboard, the folding support flap 42 is essentially a scored or cutout flap attached to wall 34 by means of foldline 43. In this preferred manner, the support flap 42 may be inwardly folded into the internal channel 40 to provide a walled support for the support member 30 to maintain the support member 30 in the upright position. While one folding support flap 42 can achieve this purpose, it is preferred to have two or more folding support flaps 42 to provide strength to the support member 30 in its upright position. Of course, the optimal number of support flaps 42 comprised within the support member 30 is determined in accordance with the desired load-carrying capacity of the collapsible pallet 10. In the most preferred embodiment, at least six folding support flaps 42 are used in each support channel 30 to allow a load carrying capacity of over 500 pounds.

As illustrated in FIGS. 6 and 7, support member 30 may be provided with locking tongues 45 and/or 46 to allow placement of the support flap 42 into receiving openings 49, 51, respectively, in the first attachment wall 32. In this manner, the folding support flap 42 may be lock-fit into the internal channel 40 to provide additional integrity for the support member 30. When opposing support flaps 42 are rotated into locking position in internal channel 40, a support compartment 50 is provided in the support member.

Referring now to FIGS. 2, 8, 9 and 10, the present invention may also be provided with support blocks 52 for placement into the support compartments 50. Preferably, support blocks 52 are used in conjunction with a plurality of opposing pairs of support flaps 42, which in their locking position form the support compartment as the part of the internal channel located between pair of opposing support flaps. This preferred embodiment results in a cumulative effect of the support flaps 42 and the support blocks 52 with respect to load-carrying capacity of the collapsible pallet 10. However, it can be appreciated that when a support block is used, it is not necessary to provide the support member 30 with support flaps 42. In such an alternative embodiment, the support flaps 42 may be omitted, and the support compartments 50 may be formed by a cutout in the second lower wall 34, or alternatively in either of the opposing side walls 36, 38 of the support member 30.

The support blocks 52 give the support members 30 added structural integrity when placed in the support compartments 50. As illustrated in FIG. 2, there are preferably three support compartments 50 for each support member 30 of a standard or regulation size pallet 10. The number of support compartments 50 in a support member 30 may be increased or decreased depending upon the length of the support member 30, and the desired load-carrying capacity of the pallet.

Figure 8:
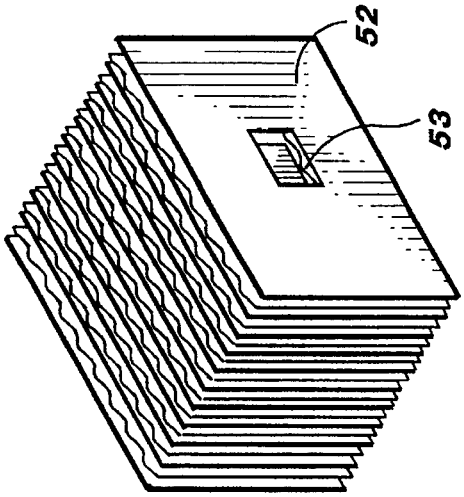
FIG. 8 is a perspective view of one embodiment of a support block as illustrated in FIG. 1.

Referring to FIG. 8, the support block 52 may be a solid block consisting of multiple plies of adhered corrugated material. It is within the scope of the present invention to use other formed materials, synthetic or natural, such as plastics, rubber or wood for the support block 52.

The shape of the support block 52 should preferably be of sufficient length, width and height to provide a snug fit relationship into the support compartment 50. Specifically, the height of the support block is substantially equal to the height of the opposing side walls of the support member, the width of the support block is substantially equal to the width of the first attachment wall and the second lower wall of the support member, and the length of the support block is substantially equal to the length of the support compartment. As such, the support block 52 is sized to frictionally adhere to the internal walls of the support compartment 50.

However, the support blocks 52 may, in an additional or alternative embodiment, be secured in the support compartments 50 by additional means beyond frictional forces. For example, locking tabs 44, formed by scorelines 44A and foldlines 44B, on the side walls 36, 38 of the support members 30 may be provided to assist in releasibly securing the support block 52 in the support compartment 50. If locking tabs 44 are used, the support block should be modified to include an opening 53 to receive the locking tab 44.

Figure 10:
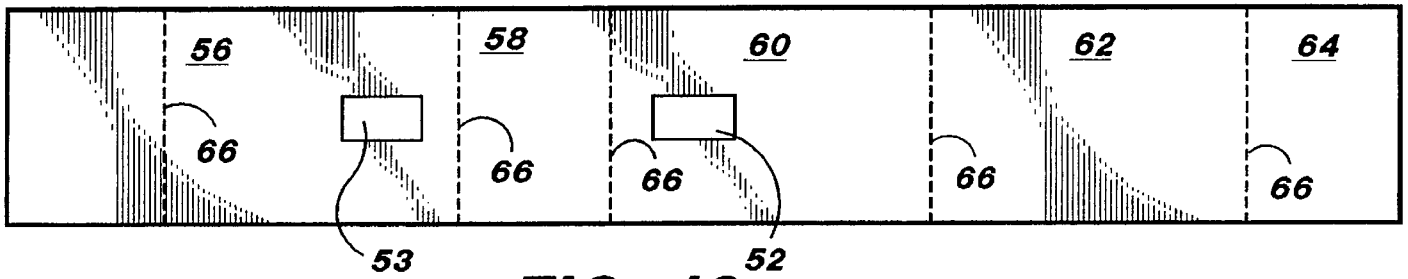
FIG. 10 is a top elevated view of the unfolded support block of FIG. 9.
Figure 9:
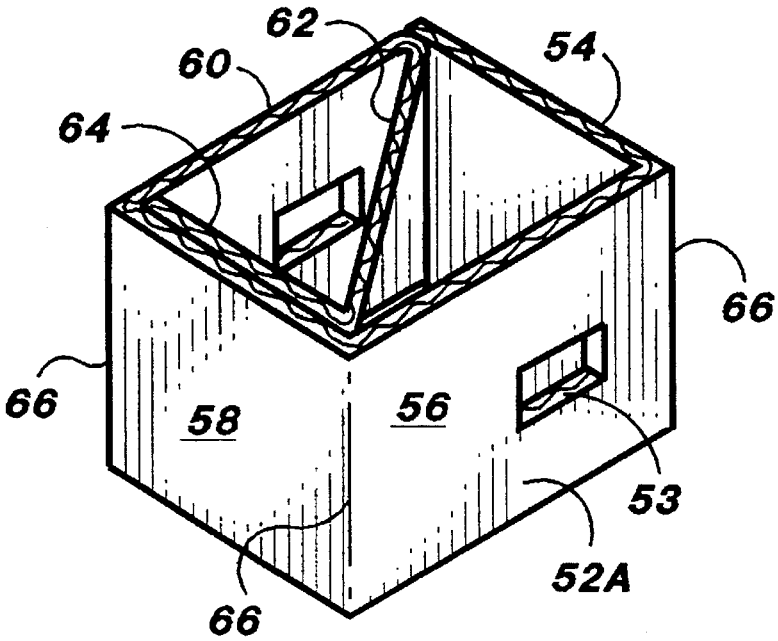
FIG. 9 is a perspective view of a second embodiment of the support black of FIG. 1.

An alternative embodiment of the support block 52 is illustrated by support block 52A, illustrated in FIGS. 9 and 10. Support block 52A may be constructed of a single elongated member, as illustrated in FIG. 10. The support block 52A preferably comprises a single sheet of corrugated fiberboard forming a plurality of walls 54, 56, 58, 60, 62 and 64 separated by foldlines 66. The dimensions of walls 54–64 depend upon the dimensions of the support compartment 50. The support block 52A is folded as illustrated in FIG. 9 such that one wall 62 provides a diagonal bridge support to add to the structural integrity of the support block 52A. Of course, other a single elongated member could be folded into alternative configurations which would serve the same function as the embodiment disclosed in FIGS. 9 and 10 and as described above. Walls 56 and 60 may also be provided with windows 53 to receive the locking tabs 44 to releasibly secure the support blocks 52A to the support channels 50.

As illustrated in FIG. 2, the pallet 10 is also provided with a cross support 70 adhered to the surface of the second lower wall 34 of the support members 30. As illustrated, the cross support 70 can be constructed of similar material as the rest of the pallet 10. The cross support 70 is generally a longitudinal support member adapted to adhere to all of the support members in perpendicular fashion in order to provide structural integrity to the support members in both the upright and the flattened position. At least one, but preferably two or more, cross supports 70 are preferred. The cross support 70 can be adhered to the support members 30 by adhesives, staples or other previously described materials. It is preferred to adhere the cross support 70 to the support members 30 by gluing or other adhesion means.

Reference is now made to FIG. 11 for an alternative embodiment of the support member 30. In this embodiment, support member 30A is made of a different material than corrugated fiberboard or cardboard. Suitable materials include plastics, fiberglass, metals or other hard planar materials. These materials typically require hinged supports to attach the walls in order to allow the support member to fold flat. Referring now to FIG. 11, there is illustrated support member 30A, which includes a plurality of hinges 80 to manipulate the support member from the flattened position to the upright position. The hinges 80 can be any typical hinge known to the art for this purpose. Preferred hinges include piano-type hinges. A piano hinge can be of any sufficient length to both connect the walls of the support member 30 and enable the walls to fold.

The support member 30A is attached to the planar pallet base 12 by adhesives, welding or other means known to the art. It is within the scope of the present invention to provide a support member 30A having a material different from the planar pallet base 12. Thus, the planar pallet base 12 can be comprised of a corrugated fiberboard while the attached support member 30A can be made of a metal or plastic material.

Reference is now made to FIG. 12 which illustrates the pallet 10 in collapsed or folded form. Without the supporting capability of the folding support flaps 42 or the support blocks 52, the pallet 10 can be folded to a substantially flattened form. This enables the pallet 10 to be easily and more conveniently stored and transported. Additionally, the support block 52A can be stored and transported in an open or flattened form. In this manner, a sufficient number of support blocks 52A can be stored within or alongside the pallet 10 for storage and transportation purposes. The ability to store the support blocks 52A in unfolded, flattened form within the collapsed pallet 10 offers significant advantages over the prior art collapsible pallets. Specifically, in addition to the fact that no additional space is necessary to store the support blocks 52 during transport, storing the support blocks 52 within the collapsed pallet 10 during transport ensures that the support blocks 52 are also readily available when the collapsed pallet 10 is to be put into its useful, upright form. When it is desired to use the pallet, the support members 30 are moved to upright position, as illustrated in FIGS. 1 and 2, and supported by the folding support flaps 42 into the internal channel 40, and if necessary or desired for increased load-carrying capacity, further supported by inserting the support blocks 52 or 52A.

When the pallet 10 is positioned for use by folding the support members 30 as illustrated in FIG. 1, it can be used as a typical pallet. The pallet includes fork channels 47, 48 to accommodate the forks of a forklift from the front or rear end.

To protect the pallet 10, the pallet 10 may be made water or environment resistant by coating the surfaces of the pallet with a water resistant material known to the industry.

While the present invention has been described with respect to preferred embodiments, it is understood that the present invention is not limited to the disclosed embodiments. Rather, this invention includes a variety of modifications and equivalent features included within the spirit and scope of the claims. The scope of the following claims is to be accorded the broadest interpretations so as to encompass all such modifications an equivalent structures and functions.

What is claimed is:

1. A collapsible pallet comprising:

a. a planar pallet base having a first upper surface, a second lower surface, a first front end, a second rear end, and first and second opposing sides; and b. a plurality of longitudinally extending collapsible support members connected to the pallet base, each support member including a first attachment wall connected to the second lower surface, a second lower wall, and first and second opposing side walls, wherein the first attachment wall and second lower wall are foldably connected to the first and second opposing side walls to form an internal channel, and wherein each second lower wall further includes at least one folding support flap capable of folding upward into the internal channel to form a support compartment therein and unfolding downward into coplanar relation with the second lower wall, and further wherein the folding support flap includes at least one locking tongue and the first attachment wall includes at least one receiving opening, each receiving opening being adapted to releasibly receive a locking tongue.

2. The collapsible pallet of claim 1 further comprising at least three spaced apart support members in parallel position to define first and second fork channels therebetween.

3. The collapsible pallet of claim 1 wherein the folding support flap is integrally connected to the support member.

4. The collapsible pallet of claim 3 comprising a plurality of folding support flaps integrally connected to support member.

5. The collapsible pallet of claim 1 wherein each support member comprises at least one support compartment adapted to receive a support block therein.

6. The collapsible pallet of claim 5 wherein the support member comprises a plurality of folding support flaps integrally connected to the support member, and wherein the support compartment comprises the part of the internal channel located between opposing support flaps.

7. The collapsible pallet of claim 5 wherein each support member includes at least one locking tab, each locking tab being adapted to fold into the support compartment and releasibly secure the support block in the support compartment.

8. The collapsible pallet of claim 7 wherein the locking tab is integrally connected to the opposing side walls.

9. The collapsible pallet of claim 1 wherein each support member comprises at least one support compartment, in combination with a support block adapted to be releasibly received within the support compartment wherein the height of the support block is substantially equal to the height of the opposing side walls of the support member, the width of the support block is substantially equal to the width of the first attachment wall and the second lower wall of the support member, and the length of the support block is substantially equal to the length of the support compartment.

10. The collapsible pallet of claim 9 wherein the support block is a solid block adapted to be received in the support compartment in a snugfit manner.

11. The collapsible pallet of claim 9 wherein the support block comprises an elongated member folded in such a manner to fit within the support compartment.

12. The collapsible pallet of claim 1 wherein each of the walls of the collapsible support members are hingedly connected.

13. The collapsible pallet of claim 1 further comprising at least one cross support connected to the support members.

14. The collapsible pallet of claim 1 wherein the pallet base and support members are made of a refoldable material selected from the group consisting of a cardboard, multi-ply corrugated paperboard, fiberboard and plastic.

15. The collapsible pallet of claim 14, wherein the pallet base comprises a multi-ply corrugated cardboard material.

16. The collapsible pallet of claim 14 wherein the support members are adhered to the pallet base by gluing.

17. The collapsible pallet of claim 15 wherein the pallet base and support members are coated with a water resistant material.

18. The collapsible pallet of claim 1 wherein the pallet base and support members are made of materials selected from the group consisting of metals, plastics, and fiberglass.

19. The collapsible pallet of claim 18 wherein the first attachment wall, second lower wall, and first and second side walls are connected by hinges.

20. The collapsible pallet of claim 1 wherein the first upper surface and second lower surface of the pallet base are continuous.

21. A collapsible pallet comprising:

a. a planar pallet base having a first upper surface, a second lower surface, a first front end, a second rear end, and first and second opposing sides;

b. at least three support members, each support member including a first attachment wall attached to the second lower surface, a second lower wall, and first and second opposing side walls, wherein the first attachment wall and second lower wall are foldably connected to the first and second side walls to form an internal channel, and wherein each support member further has at least one pair of folding support flaps integrally connected to the second lower wall whereby the support flaps may be folded into the internal channel to contact the first attachment wall and support the support members in upright position and to form a support compartment between the pair of support flaps, and further wherein least one of the first and second side walls includes at least one locking tab thereon, the locking tab being adapted to fold into the support compartment;

c. at least one cross support connected to the support members; and d. at least one support block adapted to fit within a support compartment, the support block being engageable by the locking tabs to retain the support block within the support compartment.

22. The collapsible pallet of claim 21 wherein each support member includes at least one support compartment, in combination with at least one support block, wherein each support block is a solid block adapted to be received in the support compartment in a snugfit manner.

23. The collapsible pallet of claim 21 wherein each support member includes at least one support compartment, in combination with at least one support block, wherein each support block comprises an elongated member folded in such a manner to fit within the support compartment.

24. The collapsible pallet of claim 21 wherein the pallet base and support members are made of a refoldable material selected from the group consisting of cardboard, multiple-ply corrugated paperboard, fiberboard and plastic.

25. The collapsible pallet of claim 24 wherein the support members are adhered to the pallet base by gluing.

26. The collapsible pallet of claim 24 wherein the pallet base and support members are coated with a water resistant material.

27. A collapsible pallet comprising:

a. a planar pallet base having an upper surface and a lower surface; and b. at least two collapsible support members, each support member including an attachment wall connected to the lower surface, a lower wall defining the underside of the support member, and opposing first and second side walls;

wherein the attachment wall and lower wall are foldably connected to the first and second side walls;

and wherein each lower wall further includes at least one folding support flap, whereby the attachment wall and lower wall may be positioned in spaced relation to define an internal channel between the attachment wall, lower wall, and first and second side walls, and whereby each folding support flap may be folded upward into the internal channel to maintain the collapsible support members in an upright state and to form a support compartment therein, the support compartment being accessible from the underside of the support member;

and wherein each folding support flap includes at least one locking tongue thereon;

and further wherein the attachment wall includes at least one receiving opening adapted to receive the locking tongue.

28. The collapsible pallet of claim 27 wherein each folding support flap releasibly engages the attachment wall when folded into the internal channel.

29. The collapsible pallet of claim 27 in combination with at least one support block, each support block being adapted to fit within a respective support compartment.

30. The collapsible pallet of claim 29 wherein at least one of the first and second side walls include a locking tab thereon, each locking tab being adapted to fold into the support compartment to releasibly engage the support block.

31. The collapsible pallet of claim 30 wherein the support block includes an opening therein adapted to receive the locking tab.

32. The collapsible pallet of claim 27 further comprising at least one support compartment spaced away from the opposing ends of the lower wall, whereby the support compartment may receive a support block inserted from the underside of the support member.

* * * * *